US010569287B2

(12) United States Patent
Sakata

(10) Patent No.: US 10,569,287 B2
(45) Date of Patent: Feb. 25, 2020

(54) DISCHARGE DEVICE

(71) Applicant: YOSHINO KOGYOSHO CO., LTD., Tokyo (JP)

(72) Inventor: Kota Sakata, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/092,881

(22) PCT Filed: Apr. 28, 2017

(86) PCT No.: PCT/JP2017/016949
§ 371 (c)(1),
(2) Date: Oct. 11, 2018

(87) PCT Pub. No.: WO2017/188439
PCT Pub. Date: Nov. 2, 2017

(65) Prior Publication Data

US 2019/0083996 A1 Mar. 21, 2019

(30) Foreign Application Priority Data

Apr. 28, 2016 (JP) ..... 2016-091983

(51) Int. Cl.
*B05B 11/00* (2006.01)
*B65D 83/00* (2006.01)

(52) U.S. Cl.
CPC ..... *B05B 11/3009* (2013.01); *B05B 11/00* (2013.01); *B05B 11/3014* (2013.01);
(Continued)

(58) Field of Classification Search
CPC . B05B 11/3009; B05B 11/00; B05B 11/3014; B05B 11/3059; B05B 11/3036
(Continued)

(56) References Cited

U.S. PATENT DOCUMENTS 4,082,223 A * 4/1978 Nozawa ..... B05B 11/3009 222/321.8
4,506,805 A * 3/1985 Marcon ..... B05B 11/0032 222/153.13

(Continued)

FOREIGN PATENT DOCUMENTS

CN 104623772 A 5/2015
EP 1 317 963 A1 6/2003

(Continued)

OTHER PUBLICATIONS

Jun. 6, 2017 International Search Report issued in International Patent Application No. PCT/JP2017/016949.

(Continued)

*Primary Examiner* — Patrick M. Buechner
*Assistant Examiner* — Michael J. Melaragno
(74) *Attorney, Agent, or Firm* — Oliff PLC

(57) ABSTRACT

A discharge device including a pump disposed to a container body in which contents are stored and which includes a discharge head provided with a discharge hole formed therein; a mounting cap; a support portion; and a press-down member. By rotating the press-down member, the discharge head is moved downward and the contents are discharged from the discharge hole. The discharge device includes a stopper which is movable between a restricted position where the downward movement of the discharge head is restricted and a non-restricted position where the downward movement of the discharge head is allowed.

2 Claims, 7 Drawing Sheets

(52) U.S. Cl.
CPC ..... *B05B 11/3059* (2013.01); *B05B 11/3066* (2013.01); *B65D 83/00* (2013.01)

(58) Field of Classification Search
USPC ..... 222/358, 320–321.9, 383.1, 153.13, 222/153.14
See application file for complete search history.

(56) References Cited

U.S. PATENT DOCUMENTS

| | | | | |
|---|---|---|---|---|
| 4,524,888 | A * | 6/1985 | Tada | B05B 11/0064 222/153.02 |
| 4,915,263 | A * | 4/1990 | Corba | B05B 11/3011 222/321.8 |
| 4,993,214 | A * | 2/1991 | Corba | B05B 11/3011 222/321.8 |
| 5,016,780 | A * | 5/1991 | Moretti | B05B 11/3001 222/153.13 |
| 5,156,304 | A * | 10/1992 | Battegazzore | B05B 11/3014 222/341 |
| 5,615,806 | A * | 4/1997 | Grothoff | B05B 11/3023 222/153.13 |
| 6,186,365 | B1 * | 2/2001 | DeJonge | B05B 11/3059 222/153.13 |
| 6,364,167 | B1 * | 4/2002 | Safian | B05B 11/3001 222/153.13 |
| 6,604,656 | B1 * | 8/2003 | Tseng | B05B 11/306 222/153.13 |
| 7,249,692 | B2 * | 7/2007 | Walters | B05B 11/3014 222/153.11 |
| 8,556,126 | B2 * | 10/2013 | Lee | B05B 11/306 222/153.13 |
| 8,757,447 | B2 * | 6/2014 | Gill | B05B 11/0027 222/1 |
| 9,108,213 | B2 * | 8/2015 | Gill | B05B 11/0027 |
| 2011/0155764 | A1 * | 6/2011 | Lee | B05B 11/3057 222/153.13 |

FOREIGN PATENT DOCUMENTS

| | | | |
|---|---|---|---|
| JP | 2003-230854 | A | 8/2003 |
| JP | 2008-030798 | A | 2/2008 |
| JP | 2010-253443 | A | 11/2010 |
| JP | 2011-251219 | A | 12/2011 |
| JP | 5111078 | B2 | 12/2012 |
| JP | 2014121668 | A | 7/2014 |
| JP | 3197137 | U | 4/2015 |

OTHER PUBLICATIONS

Jul. 3, 2019 Office Action issued in Chinese Patent Application No. 201780025752.5.
Nov. 20, 2019 Search Report issued in European Patent Application No. 17789720.4.

* cited by examiner

DISCHARGE DEVICE

FIELD OF THE INVENTION

The present invention relates to a discharge device. Priority is claimed on Japanese Patent Application No. 2016-091983, filed Apr. 28, 2016, the content of which is incorporated herein by reference.

BACKGROUND ART

Conventionally, for example, a discharge device disclosed in the following Patent Document 1 is known. The discharge device includes a pump disposed at a mouth portion of a container body, in which contents are stored, to be movable downward in a state where the pump is pushed upwardly and having a discharge head having a discharge hole for the contents which opens forward, a mounting cap which allows the pump to be mounted on the mouth portion of the container body, a support portion standing up on a rear portion of the mounting cap, and a press-down member disposed at the support portion to be rotatable around a rotating axis and pressing the discharging head down. Due to such a constitution, when the contents are discharged, the discharge head is moved downward by rotating the press-down member downward around the rotating axis. Therefore, the contents can be discharged to the outside through the discharge hole.

CITATION LIST

Patent Document

[Patent Document 1]
Japanese Unexamined Patent Application, First Publication No. 2008-30798

SUMMARY OF INVENTION

Technical Problem

Incidentally, in this type of discharge device, in general, a stopper is provided to prevent the contents from being discharged to the outside when the discharge device is not in use. The conventional stopper is sandwiched between the support portion and the press-down member so as to prevent the press-down member from rotating downward around the rotating axis. However, in this constitution, when a force is applied not to the press-down member but to a single discharge nozzle body, a discharge nozzle may be pushed down by a certain distance, and the contents may be discharged.

The present invention has been made in view of such circumstances, and an object thereof is to provide a discharge device capable of more reliably preventing discharge of contents when the discharger device is not in use.

Solution to Problem

A first aspect of the present invention is a discharge device including a pump disposed in a mouth portion of a container body, in which contents are stored, to be movable downward in a state where an upward force is applied to the pump, the pump including a discharge head provided with a discharge hole opening forward; a mounting cap mounting the pump on the mouth portion of the container body; a support portion standing up on a rear portion of the mounting cap;

and a press-down member disposed at the support portion to be rotatable around a rotating axis and configured to press the discharge head down, wherein by rotating the press-down member downward around the rotating axis, the discharge head is moved downward and the contents are discharged from the discharge hole. The discharge device include a stopper which is movable between a restricted position where downward movement of the discharge head is restricted and a non-restricted position where the downward movement of the discharge head is allowed, the discharge head includes a stem disposed to be movable downward in a state where an upward force is applied to the stem, a mounting tube portion mounted on an upper end of the stem, a nozzle tube portion protruding forward from the mounting tube portion and provided with the discharge hole formed in a front end of the nozzle tube portion, a first locked portion protruding rearward from the mounting tube portion, and a pair of second locked portions protruding from the mounting tube portion toward both sides in a left and right direction orthogonal to a forward and rear direction and to a vertical direction. The press-down member has a pair of engaging portions configured to engage with the pair of second locked portions from an upper side and to press the discharge head down via the second locked portion, the stopper has a first restricting portion and a second restricting portion, the first restricting portion is disposed to be in contact with or close to the first locked portion on a lower side of the first locked portion when the stopper is located at the restricted position and is disposed to be apart from the first locked portion when the stopper is located at the non-restricted position, and the second restricting portion is disposed to be in contact with or close to the pair of the second locked portions on a lower side of the second locked portions when the stopper is located at the restricted position and is disposed to be apart from the second locked portions when the stopper is located at the non-restricted position.

According to the first aspect of the discharge device of the present invention, when the stopper is moved to the restricted position, the stopper comes into contact with or approaches the first locked portion and the second locked portion of the discharge head. Therefore, even when a force is applied to the discharge head alone, the stopper comes into contact with the first locked portion and the second locked portion and the discharge head is directly supported. Therefore, the contents are not discharged. On the other hand, when the stopper is moved to the non-restricted position, the stopper is apart from the first locked portion and the second locked portion which protrude from the discharge head. Therefore, the downward movement of the discharge head is allowed, and usual use of the discharge device becomes possible.

Further, the first locked portion protruding rearward from the mounting tube portion mounted on the upper end of the stem is supported by the first restricting portion, and the second locked portions protruding from the mounting tube portion to both sides in the left and right direction are supported by the second restricting portions. Therefore, the stem is surrounded by the first and second restricting portion in three directions, and thus the discharge head can be supported by the stopper. Accordingly, the discharge head can be stably supported by the stopper, and the downward movement of the discharge head can be more stably restricted.

Further, when a position of the upper end of the first restricting portion and positions of the upper ends of the pair of second restricting portions are at the same position in the vertical direction, the upper end of the first restricting portion and the upper ends of the pair of second restricting portions are disposed on the same plane orthogonal to the vertical direction, and the discharge head can be more stably supported by the three upper ends. Therefore, it is possible to restrict the downward movement of the discharge head more stably.

Further, since the second locked portion protrudes from the mounting tube portion mounted on the upper end of the stem in the left and right direction, the second locked portion is located at substantially the same position as the stem in the forward and rearward direction. Therefore, by supporting the second locked portion with the second restricting portion, it is possible to support the discharge head such that a center of the stem in the forward and rearward direction is sandwiched on both sides in the left and right direction by the second restricting portions. Thus, it is possible to more stably restrict the downward movement of the discharge head. Further, when an external force is applied downward to the nozzle tube portion, a force is applied to the second locked portion in a direction of pressing the second locked portion against the second restricting portion. Therefore, a force is applied to the second restricting portion in a direction in which the second restricting portion is pressed downward. Accordingly, since an external force is applied to the nozzle tube portion, the second restricting portion is pressed downward by the second locked portion even when the first locked portion rises with respect to the first restricting portion. As a result, it is possible to restrict the discharge head from moving downward and to minimize shifting of the stopper toward the non-restricted position. It is also possible to suppress the deterioration of the sealing property between the stem and the mounting tube portion.

Further, the second locked portion is a portion which is engaged with the engaging portion of the press-down member and is a portion which directly receives a force from the press-down member. Therefore, the second locked portion is supported by the second restricting portion, and thus the force applied to the discharge head from the press-down member can be directly received by the stopper. Accordingly, the discharge head can be more stably supported by the stopper, and the downward movement of the discharge head can be more stably restricted.

A second aspect of the present invention is the discharge device of the first aspect in which each one of the second locked portions has a flat surface which faces an upper end of the second restricting portion when the stopper is located at the restricted position.

According to the second aspect of the discharge device of the present invention, it is possible to stably restrict the movement of the second locked portion using the second restricting portion. Therefore, it is possible to further suppress the leakage of the contents to the outside.

Advantageous Effects of Invention

According to the discharge device of the present invention, it is possible to more reliably prevent a discharge of contents when not in use.

DESCRIPTION OF EMBODIMENTS

Hereinafter, an embodiment of a discharge device according to the present invention will be described with reference to the drawings. In each drawing used in the following description, the scale is appropriately changed to allow each member to have a recognizable size.

Figure 1:
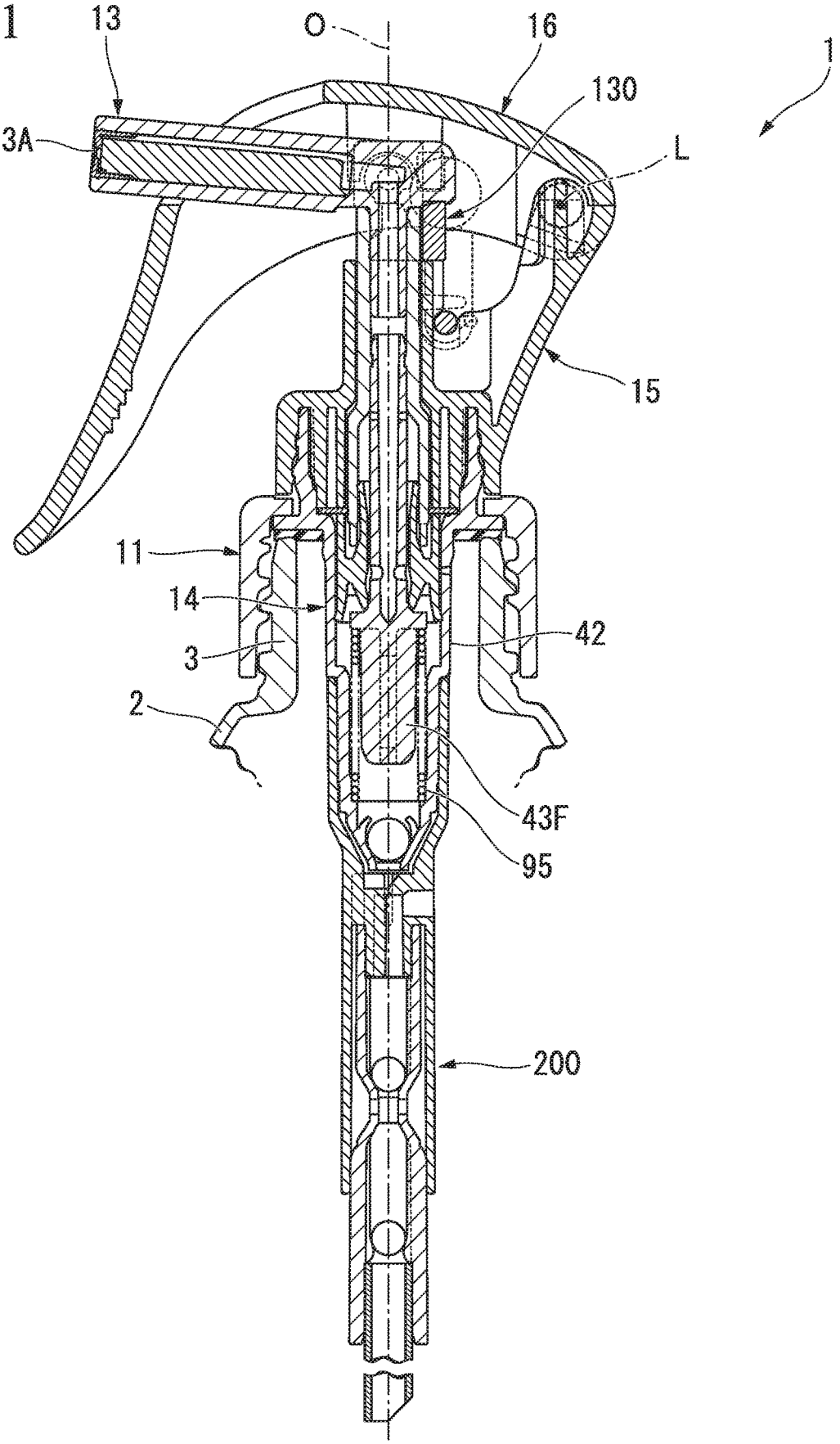
FIG. 1 is an axial cross-sectional view showing a discharge device in which an invertible adapter is mounted.

As shown in FIG. 1, a discharge device 1 of the embodiment is equipped with an invertible adapter 200. The invertible adapter 200 supplies liquid contents into a cylinder 42 when a pressure inside the cylinder 42 of the discharge device 1 is negative. The cylinder 42 will be described later in both an upright state and an inverted state of the discharge device 1.

Figure 2:
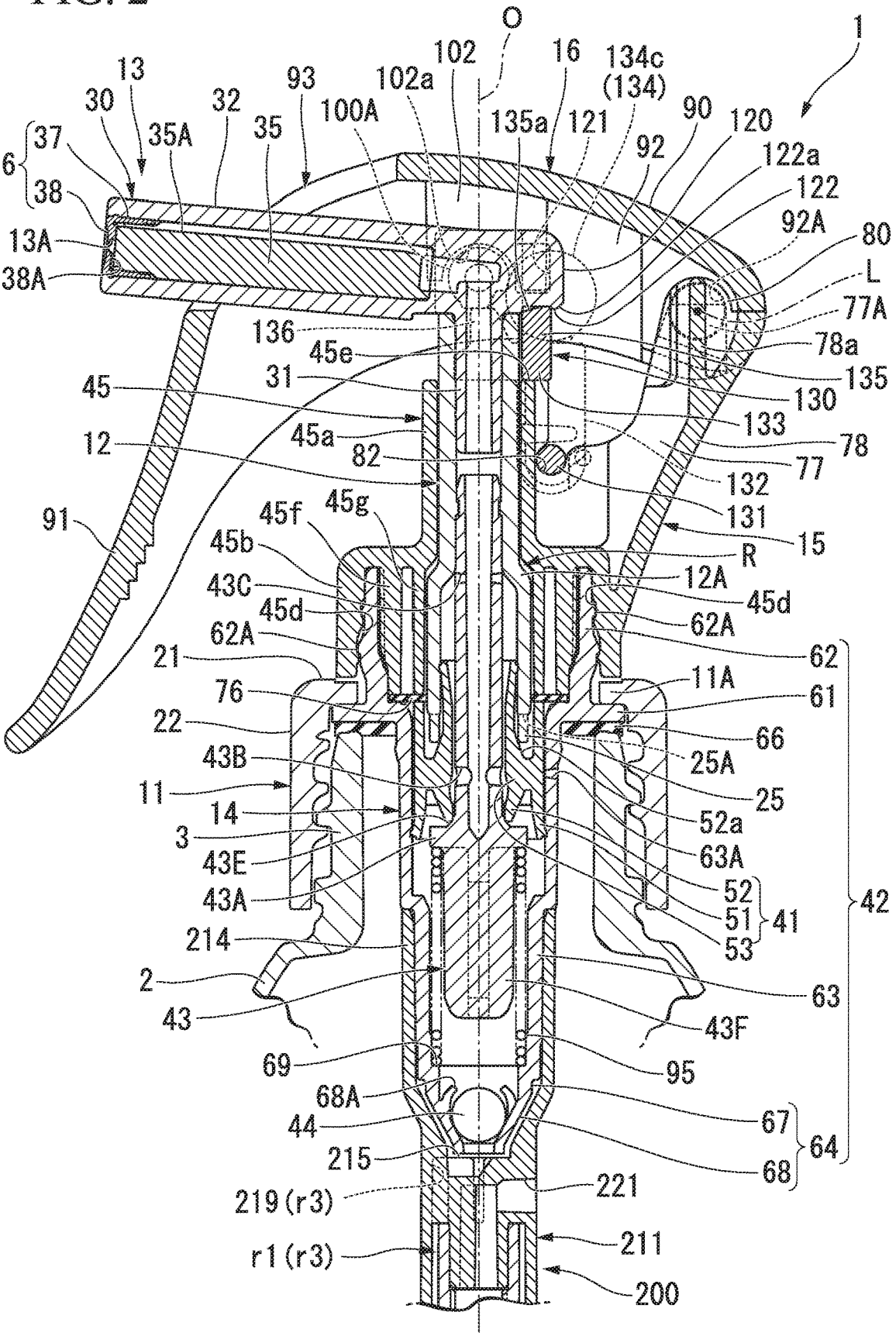
FIG. 2 is an axial cross-sectional view showing an upper half of the discharge device shown in FIG. 1.

As shown in FIG. 2, the discharge device 1 includes a mounting cap 11 provided with a cylindrical shape with a top and mounted on a mouth portion 3 of a container body 2 in which contents (not shown) are stored, a pump 14 disposed at the mouth portion 3 of the container body 2 to be movable downward in a state where the pump 14 is pushed upwardly and having a discharge head 13 having a discharge hole 13A for the contents which opens forward, a support portion 15 standing up on a rear portion of the mounting cap 11, and a press-down member 16 disposed at the support portion 15 to be rotatable around a rotating axis L and configured to press the discharge head 13 down.

In this discharge device 1, the discharge head 13 is moved downward by rotating the press-down member 16 in a downward direction described later around the rotating axis L, and the contents are discharged from the discharge hole 13A. The discharge head 13 includes a stem 12 provided with a cylindrical shape, and a head body 30 mounted on an upper end of the stem 12 and having the discharge hole 13A formed in the head body 30.

The mounting cap 11 and the stem 12 are disposed such that central axes thereof are located on a common axis. Hereinafter, the common axis is defined a central axis O, a direction along the central axis O in FIG. 2 is defined as a vertical direction, a side closer to the press-down member 16 in the vertical direction is defined as an upper side, and a side closer to a cylinder 42 is referred to as a lower side. Further, a direction orthogonal to the central axis O in a plan view when seen from the central axis O is defined as a radial direction, and a circumferential direction around the central axis O is defined as a circumferential direction. Also, in the radial direction, one direction in which a side closer to a discharge hole 13A of the discharge head 13 is a front side and a side opposite thereto is a rear side is defined as a forward and rearward direction. A direction orthogonal to the vertical direction and the forward and rearward direction is defined to as a left and right direction.

The mounting cap 11 is a cap configured to allow the pump 14 to be mounted on the mouth portion 3 of the container body 2. The mounting cap 11 includes a top wall portion 21 provided with a circular shape in a plan view and with an opening formed at a center of the top wall portion 21, and a circumferential wall portion 22 provided with a cylindrical shape and extending downward from an outer circumferential edge of the top wall portion 21. The top wall portion 21 and the circumferential wall portion 22 are disposed coaxially with the central axis O. A female screw configured to be screwed to a male screw formed on an outer circumferential surface of the mouth portion 3 of the container body 2 is formed on an inner circumferential surface of the circumferential wall portion 22. The mounting cap 11 is not limited to a case where the mounting cap 11 is screwed to the mouth portion 3 of the container body 2 and may be mounted by, for example, undercut fitting.

The pump 14 includes the discharge head 13, a piston 41 provided with a double cylindrical shape and connected to the stem 12 of the discharge head 13, a cylinder 42 provided with a cylindrical shape and in which the piston 41 is accommodated to be slidable vertically, a piston guide 43 provided with a cylindrical shape with a bottom, extending downward from the stem 12, and passing through the inside of the piston 41 in the vertical direction, a valve body 44 provided with a spherical shape and disposed in the cylinder 42, and a guide tube 45 provided with a cylindrical shape and surrounding the stem 12 from the outside.

The stem 12 is inserted through an inside of the guide tube 45 to be vertically movable. At this time, an upper end of the stem 12 protrudes upward more than the guide tube 45. An inner diameter and an outer diameter of a lower portion of the stem 12 are larger than an inner diameter and an outer diameter of an upper portion of the stem 12. Further, an enlarged diameter portion 12A is provided between the upper portion and the lower portion of the stem 12.

An elastic portion 25 provided with a relatively thin-walled cylindrical shape and being continuous to the lower side of the enlarged diameter portion 12A is formed at a lower end of the stem 12. In the elastic portion 25, a plurality of cut-out portions 25A provided with a slit shape, opening downward, and extending in the vertical direction are formed at intervals in the circumferential direction.

The head body 30 includes a mounting tube portion 31 provided with a cylindrical shape with a top and mounted on an upper end of the stem 12, a nozzle tube portion 32 provided with a cylindrical shape and protruding forward from the mounting tube portion 31, a first locked portion 120 protruding rearward from the mounting tube portion 31, and a pair of second locked portions 100A protruding from the mounting tube portion 31 toward both sides in the left and right direction. The mounting tube portion 31 is fitted into the stem 12.

A core rod body 35 extending in the forward and rearward direction and a tip 36 provided with a cylindrical shape with a top and adhered to a front end of the core rod body 35 are disposed in the nozzle tube portion 32. A plurality of flow path grooves 35A configured to allow a flow of the contents between an inner circumferential surface of the nozzle tube portion 32 and the outer circumferential surface of the core rod body 35 are formed in an outer circumferential surface of the core rod body 35 in the forward and rearward direction.

The tip 36 includes a cylindrical tip tube portion 37 provided with a cylindrical shape, disposed coaxially with the core rod body 35, and into which the core rod body 35 is fitted, and an end wall portion 38 provided at a front end of the tip tube portion 37. The tip tube portion 37 is fitted into the nozzle tube portion 32. The end wall portion 38 is in contact with a front end surface of the core rod body 35. A spin flow path 38A communicating with the flow path grooves 35A of the core rod body 35 is formed in a rear surface of the end wall portion 38 which is in contact with the front end surface of the core rod body 35. The discharge hole 13A communicating with the spin flow path 38A is formed in a center portion of the end wall portion 38. The tip 36 allows the contents to be discharged in a sprayed state. In addition, it is possible to discharge the contents in the form of bubbles, straight lines, or the like by changing a shape of the tip 36 and a nozzle tip, or the like. For example, by providing a foaming member such as a mesh at the nozzle tip of the embodiment, it is possible to discharge the contents in the form of bubbles.

The first locked portion 120 protrudes rearward from an upper end of the mounting tube portion 31. That is, the first locked portion 120 protrudes in a direction opposite to a direction in which the nozzle tube portion 32 protrudes. The first locked portion 120 is formed in a block shape having a pair of lightening grooves 121 in the left and right direction. The first locked portion 120 faces a part of the upper end opening edge 45*e* of the guide tube 45 with a gap between the first locked portion 120 and the part in the vertical direction.

An engaging protrusion 122 configured to prevent movement of a stopper 130 from a restricted position to a non-restricted position which will be described later is formed on the first locked portion 120. The engaging protrusion 122 protrudes downward from a rear end of the first locked portion 120. An inclined surface 122*a* inclined upward and rearward is formed at a rear portion of the engaging protrusion 122.

Figure 3:
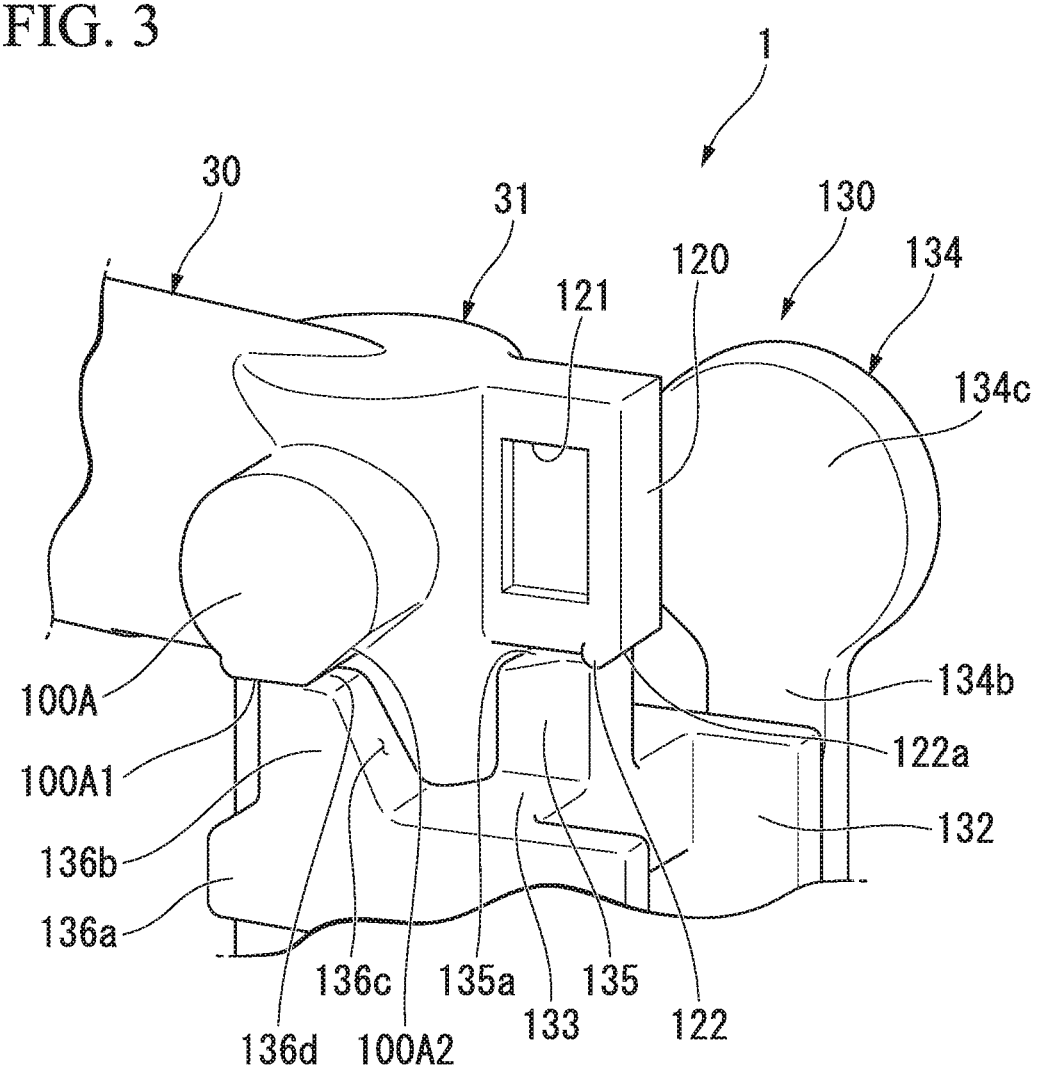
FIG. 3 is a perspective view showing a part of the discharge device shown in FIG. 1.

The pair of second locked portions 100A protrude toward a pair of side plate portions 92 which will be described later from side surfaces of an upper end of the mounting tube portion 31 which face in the left and right direction. The second locked portion 100A is formed in a substantially circular column shape as shown in FIG. 3. The second locked portion 100A has a flat surface 100A1 directed downward and an inclined surface 100A2 directed rearward obliquely downward. The flat surface 100A1 is, for example, a flat surface orthogonal to the vertical direction. The inclined surface 100A2 is connected to a rear end of the flat surface 100A1 and extends rearward obliquely upward from the rear end of the flat surface 100A1.

As shown in FIG. 2, the piston 41 includes a cylindrical sliding portion 51 provided with a cylindrical shape, a closing portion 52 provided with a cylindrical shape and disposed inward from the sliding portion 51 in the radial direction, and an annular connecting portion 53 provided with an annular shape in a plan view and connecting a middle portion of the sliding portion 51 in the vertical direction with a middle portion of the closing portion 52 in the vertical direction. The sliding portion 51, the closing portion 52, and the annular connecting portion 53 are disposed coaxially with the central axis O.

A lower end of the sliding portion 51 is curved to be gradually directed radially outward from the upper side toward the lower side. Therefore, the lower end of the sliding portion 51 is in sliding contact with an inner circumferential surface of the cylinder 42. A lower end of the closing portion 52 is curved to be gradually directed radially inward from the upper side toward the lower side. Therefore, the lower end of the closing portion 52 is in contact with a contact portion 43E formed near a flange portion 43A of the piston guide 43 which will be described later. An upper end of the closing portion 52 is curved to be gradually directed radially outward from the lower side toward the upper side.

Therefore, the upper end of the closing portion 52 is in sliding contact with an inner circumferential surface of the lower end of the stem 12.

An outer circumferential surface of the closing portion 52 has a tapered portion 52*a* provided with an annular shape and connected to an upper end of the annular connecting portion 53. An outer diameter of the tapered portion 52*a* decreases upwards from the upper end of the annular connecting portion 53. A lower end opening edge of the elastic portion 25 is in contact with the tapered portion 52*a*.

The cylinder 42 includes a flange-shaped support plate portion 61, a upstanding tube portion 62 provided with a cylindrical shape and extending upward from the support plate portion 61, an upper tube portion 63 provided with a cylindrical shape and extending downward from an opening edge of the support plate portion 61, and a lower tube portion 64 provided with a cylindrical shape and extending downward from a lower end of the upper tube portion 63. The support plate portion 61, the upstanding tube portion 62, and the lower tube portion 64 are disposed coaxially with the central axis O.

The support plate portion 61 protrudes radially outward from a circumferential wall portion of the cylinder 42 and is disposed on an upper end opening edge of the mouth portion 3. A flange-shaped pressing plate portion 11A provided with a flange shape, protruding radially inward, and sandwiching the support plate portion 61 between the upper end opening edge of the mouth portion 3 and the pressing plate portion 11A, is formed in the mounting cap 11. A first packing 66 provided with an annular shape is interposed between the support plate portion 61 and the upper end opening edge of the mouth portion 3.

The upstanding tube portion 62 stands upward through an opening portion of the top wall portion 21. An engaging protrusion 62A protruding radially outward and engaging with an engaging groove 45*d* formed in the guide tube 45 is provided on the upstanding tube portion 62. The engaging groove 45*d* and the engaging protrusion 62A are provided annularly in the circumferential direction. In the example of FIG. 2, two engaging grooves 45*d* and two engagement protrusion 62A are provided in the vertical direction. An air hole 63A configured to communicate the inside with the outside of the upper tube portion 63 is formed in an upper portion of the upper tube portion 63. The air hole 63A can be closed from the inside of the cylinder 42 by an outer circumferential surface of the annular connecting portion 53.

The lower tube portion 64 includes a straight tube portion 67 extending downward from a lower end opening edge of the upper tube portion 63, and a tapered tube portion 68 extending downward from a lower end of the straight tube portion 67 and of which an inner diameter and an outer diameter decrease in diameter from the upper side to the lower side. The inner diameter of the straight tube portion 67 is smaller than an inner diameter of the lower end of the upper tube portion 63, and a stepped portion 69 is provided between the inner circumferential surface of the straight tube portion 67 and the inner circumferential surface of the upper tube portion 63 such that an inner diameter of the cylinder 42 becomes smaller from the upper side to the lower side.

The valve body 44 is disposed on the inside of the tapered tube portion 68 to be detachable from a taper surface of the tapered tube portion 68. The valve body 44 is constituted with a ball valve formed in a spherical shape and formed of a synthetic resin. It is preferable that the valve body 44 be formed of a synthetic resin in view of minimizing time and labor for sorting materials during disposal. Further, the valve body 44 may be formed of a metal or the like. It may also be a check valve using various valve bodies in place of the ball valve.

A restricting protruding portion 68A inclined upward from the outside toward the inside in the radial direction protrudes on an inner circumferential surface of the tapered tube portion 68. An inner diameter of an upper end of the restricting protruding portion 68A is smaller than that of the valve body 44. Thus, the restricting protruding portion 68A restricts the valve body 44 from coming off from the tapered tube portion 68 upward. A gap which interrupts the extension of the restricting protruding portion 68A in the circumferential direction is formed in the restricting protruding portion 68A.

As shown in FIG. 2, flange portion 43A of the piston guide 43 located below the closing portion 52 of the piston 41 is formed in a disk shape which protrudes radially outward with respect to a circumferential tube portion located above the flange portion 43A. The contact portion 43E of which an outer diameter gradually decreases upward from an upper surface of the flange portion 43A is formed at a lower end of the circumferential tube portion of the piston guide 43.

A communication hole 43B configured to communicate the inside of the piston guide 43 with the inside of the cylinder 42 is formed in the circumferential tube portion of the piston guide 43. For example, the communication hole 43B is formed on both sides sandwiching the central axis O in the radial direction. The communication hole 43B is located above the contact portion 43E and the lower end of the closing portion 52, and communication between the inside of the upper tube portion 63 of the cylinder 42 and the communication hole 43B is cut off.

A through-hole 43C communicating the inside of the piston guide 43 with the inside of the cylinder 42 is formed in the circumferential tube portion of the piston guide 43. For example, like the communication hole 43B, the through-hole 43C is formed on both sides sandwiching the central axis O in the radial direction. The through-hole 43C opens toward an inner circumferential surface of the enlarged diameter portion 12A of the stem 12. The through-hole 43C is located above the communication hole 43B. A portion of the piston guide 43 located above the through-hole 43C is fitted into the stem 12. Therefore, the piston guide 43 vertically moves integrally with the stem 12. The piston guide 43 has a cylindrical spring guide portion 43F which protrudes downward from the flange portion 43A.

A coil spring 95 which is a pushing member is disposed inside the cylinder 42. The coil spring 95 is mounted on an outer circumferential surface of the spring guide portion 43F. An upper end of the coil spring 95 is in contact with a lower end of the flange portion 43A of the piston guide 43. A lower end of the coil spring 95 is in contact with the stepped portion 69 (an upper end of the straight tube portion 67). The coil spring 95 applies an upward elastic force (spring force) to the piston guide 43 via the flange portion 43A. Therefore, the upward force is applied to the discharge head 13. The coil spring 95 is disposed in the cylinder 42 in a state where the coil spring 95 is deformed in the vertical direction, and the upward force is applied to the discharge head 13 using the elastic force even in a normal state.

The guide tube 45 is disposed coaxially with the central axis O. The guide tube 45 includes a guide tube portion 45*a*, a fitting tube portion 45*b*, a middle tube portion 45*f*, and an inner tube portion 45*g*. The guide tube portion 45*a* forms an upper portion of the guide tube 45, and the fitting tube portion 45*b*, the middle tube portion 45*f*, and the inner tube portion 45*g* form a lower portion of the guide tube 45. The stem 12 is inserted through the guide tube portion 45*a* to be movable downward. The guide tube portion 45*a* is formed in a cylindrical shape, and the fitting tube portion 45*b* is formed in a cylindrical shape disposed on the outside of the guide tube portion 45*a* in the radial direction. The middle tube portion 45*f* is formed in a cylindrical shape and disposed on the inside of the fitting tube portion 45*b* in the radial direction. The inner tube portion 45*g* is formed in a cylindrical shape and disposed on the inside of the middle tube portion 45*f* in the radial direction. The guide tube portion 45*a*, the fitting tube portion 45*b*, the middle tube portion 45*f*, and the inner tube portion 45*g* are disposed coaxially with the central axis O.

The fitting tube portion 45*b* is fitted onto the upstanding tube portion 62. A lower end of the fitting tube portion 45*b* faces the plate portion 11A of the mounting cap 11 across a gap in the vertical direction. The lower end of the fitting tube portion 45*b* is disposed such that the plate portion 11A is interposed between the support plate portion 61 and the lower end of the fitting tube portion 45*b*.

The middle tube portion 45*f* is fitted into the upstanding tube portion 62. A lower end of the middle tube portion 45*f* is pressed against a radially inner end of the support plate portion 61 via a second packing 76 provided with an annular shape. The inner tube portion 45*g* is fitted onto the lower portion of the stem 12. A lower end of the inner tube portion 45*g* is disposed such that the second packing 76 is interposed between an upper end of the sliding portion 51 and the lower end of the inner tube portion 45*g*.

The second packing 76 is fitted onto the lower portion of the stem 12 in the vicinity of the elastic portion 25. A radially outer end of the second packing 76 is sandwiched between the lower end of the middle tube portion 45*f* and an upper surface of the support plate portion 61. A radially inner end of the second packing 76 is sandwiched between the lower end of the inner tube portion 45*g* and the upper end of the sliding portion 51 in the state shown in FIG. 2. The second packing 76 can cut off communication between an external air introduction path R formed between the stem 12 and the guide tube 45 and an upper space in the cylinder 42.

The support portion 15 for supporting the press-down member 16 protrudes rearward from the fitting tube portion 45*b* of the guide tube 45 and includes a pair of side wall portions 77 provided to be spaced apart from each other in the left and right direction, and a rear wall portion 78 connecting rear end edges of the side wall portions 77 in the left and right direction.

The side wall portions 77 extend gradually upward from the front side toward the rear side. A protruding piece 80 protruding upward to be formed in a semicircular shape in a front view when seen in the left and right direction is formed at an upper end of each of the side wall portions 77. A shaft body 77A provided with a cylindrical shape and protruding outward in the left and right direction on an outer surface of each of the protruding pieces 80. The shaft body 77A is disposed behind the stem 12.

An imaginary axis passing through a center of the shaft body 77A and extending in the left and right direction becomes the rotating axis L of the press-down member 16. Therefore, the rotating axis L is disposed behind the stem 12 and extends in the left and right direction orthogonal to both the vertical direction and the forward and rearward direction. Further, a reinforcing wall 78*a* protruding upward to be located inside the protruding piece 80 and connecting the inner surfaces of the pair of side wall portions 77 with each other and the pair of protruding pieces 80 with each other in the left and right direction is formed on an inner surface of the rear wall portion 78.

As described above, since the support portion 15 protrudes upward and rearward from a rear portion of the fitting tube portion 45*b* of the guide tube 45, the support portion 15 is disposed on a rear portion of the mounting cap 11 in a state where the support portion 15 stands up. In the illustrated example, the support portion 15 stands up from the rear portion of the fitting tube portion 45*b* of the guide tube 45, but the present invention is not limited to this case. For example, the support portion 15 may protrude upward and rearward from the rear portion of the mounting cap 11.

The press-down member (trigger) 16 is mounted on the support portion 15 via the shaft body 77A. Therefore, the press-down member 16 is connected to the support portion 15 to be rotatable (pivotable) around the rotating axis L. The press-down member 16 includes a top plate portion 90 covering the discharge head 13 from the upper side, a front plate portion 91 extending forward and obliquely downward from a front edge of the top plate portion 90, and a pair of side plate portions 92 extending downward from side edges located on both sides of the top plate portion 90 in the left and right direction and facing each other in the left and right direction. The discharge head 13 is disposed in an internal space surrounded by the top plate portion 90 and the pair of side plate portions 92. Therefore, the pair of side plate portions 92 are disposed to sandwich the discharge head 13 in the left and right direction.

The top plate portion 90 is provided with a shape that is smoothly curved to expand upward. A rear end of the top plate portion 90 is in contact with an upper end opening edge of the rear wall portion 78 of the support portion 15 from the upper side. Therefore, the press-down member 16 is positioned in a state where upward rotation about the rotating axis L is restricted.

A through-hole 93 passing through the top plate portion 90 is formed in a front portion of the top plate portion 90. The through-hole 93 is formed in a center portion of the top plate portion 90 in the left and right direction and formed to be open forward. Accordingly, the front portion of the top plate portion 90 is formed to be divided into two portions in the left and right direction.

The front plate portion 91 extends forward and obliquely downward from the front edge of the top plate portion 90 divided into two portions. A lower portion of the front plate portion 91 is a finger hooking portion for putting a finger tip thereon. The nozzle tube portion 32 of the head body 30 is inserted through the through-hole 93. Therefore, the nozzle tube portion 32 protrudes from the press-down member 16 through the through-hole 93.

The pair of side plate portions 92 sandwich the discharge head 13 and the support portion 15 in the left and right direction. A shaft hole 92A through which the shaft body 77A is inserted is formed in an inner surface of the rear side of each of the pair of side plate portions 92. Therefore, the press-down member 16 is supported to be rotatable around the shaft body 77A, that is, around the rotating axis L.

Figure 4:
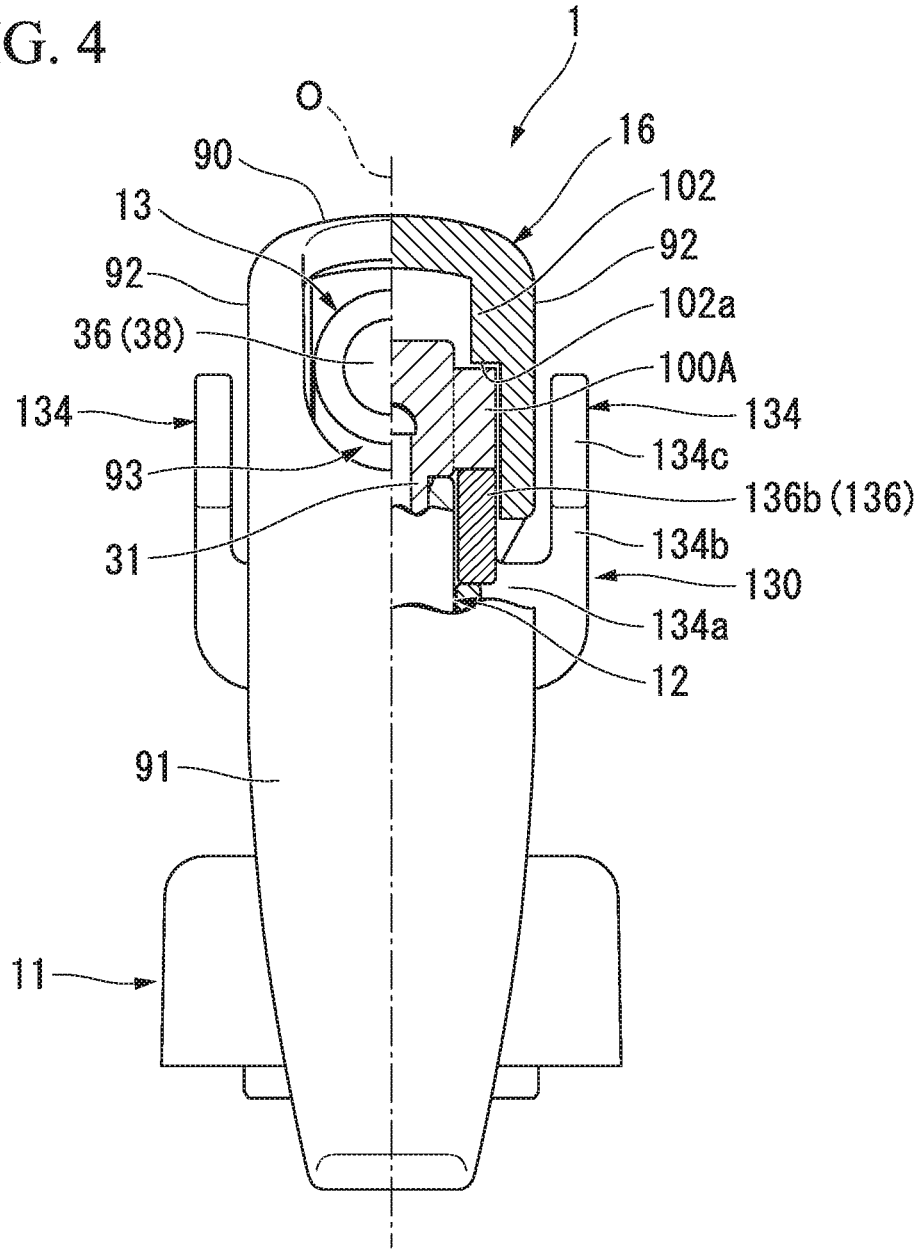
FIG. 4 is a front partial cross-sectional view of the discharge device shown in FIG. 1 when seen from a front side.

As shown in FIGS. 2 and 4, the press-down member 16 includes a pair of engaging portions 102 configured to engage with the pair of second locked portions 100A from the upper side. The pair of engaging portions 102 are provided on inner surfaces of the pair of side plate portions 92, respectively. The engaging portions 102 protrude from the inner surfaces of the side plate portions 92 in a direction of approach to the discharge head 13. An upper end of the engaging portion 102 is connected to the top plate portion 90. An engaging concave portion 102*a* depressed upward is formed at a lower end of the engaging portion 102. The shape of the engaging concave portion 102*a* in a front view seen in the left and right direction is a substantially semi-circular arc shape being convex upward as shown in FIG. 2. As shown in FIG. 4, the engaging concave portion 102*a* is located above the second locked portion 100A and faces the second locked portion 100A.

Accordingly, when the press-down member 16 is rotated downward around the rotating axis L, the engaging concave portion 102*a* engages with the second locked portion 100A from the upper side, and thus the second locked portion 100A can be pressed down from the upper side. Therefore, the discharge head 13 can be moved downward. That is, the press-down member 16 presses the discharge head 13 down via the second locked portion 100A due to the engaging portion 102. When the downward rotation of the press-down member 16 is released, as described above, since the coil spring 95 applies the upward force to the discharge head 13, the upward force is applied to the press-down member 16 via the second locked portion 100A and the engaging portion 102. Therefore, the press-down member 16 reversely rotates upward around the rotating axis L and returns to an original position.

The stopper 130 is a member provided to be rotatable around a shaft body 131 (refer to FIG. 2) parallel to the rotating axis L of the press-down member 16 and configured to restrict the discharge head 13 from moving downward (hereinafter, also referred to as "downward movement"). The stopper 130 can be switched to a restricted position (position shown in FIG. 2) which restricts the downward movement of the discharge head 13. The stopper 130 is rotated rearward around the shaft body 131 with respect to the restricted position, the stopper 130 can be switched to a non-restricted position (position shown in FIG. 5) which allows downward movement of the discharge head 13. A positional relationship between the respective portions of the stopper 130 described below is a positional relationship when the stopper 130 is located at the restricted position.

Figure 6:
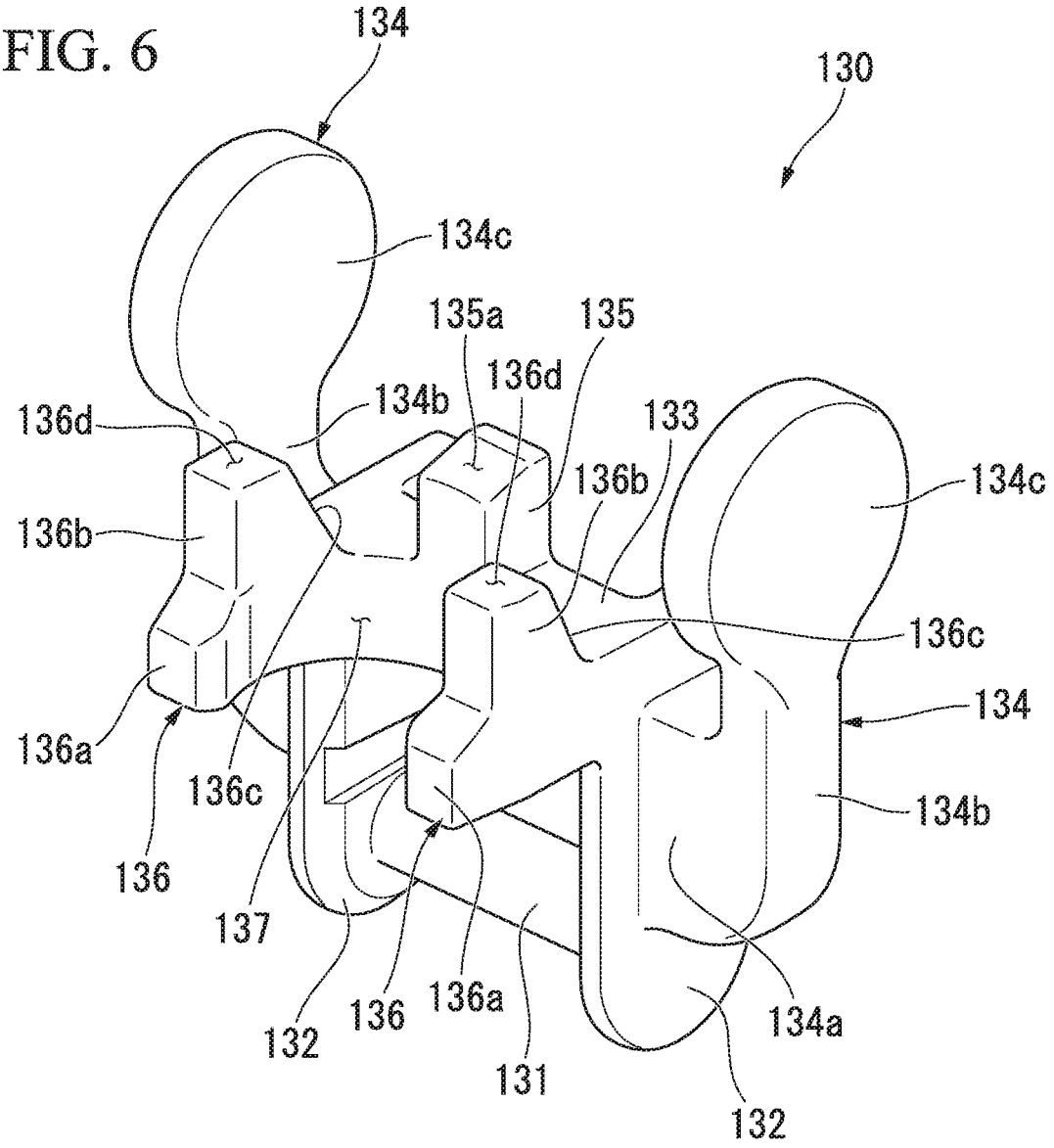
FIG. 6 is a perspective view showing a stopper provided in the discharge device.

As shown in FIG. 6, the stopper 130 includes a pair of stopper side wall portions 132 disposed at intervals in the left and right direction, a shaft body 131 extending in the left and right direction and connecting the pair of stopper side wall portions 132 therebetween, a connecting base portion 133 connecting upper ends of the pair of stopper side wall portions 132 with each other, a first restricting portion 135 protruding upward from the connecting base portion 133, a pair of right and left second restricting portions 136 protruding forward from the connecting base portion 133, and a knob portion 134 protruding from each of the pair of stopper side wall portions 132 toward the outside in the left and right direction.

The pair of stopper side wall portions 132 respectively extend in the vertical direction. The stopper side wall portion 132 is provided with a plate shape extending in a plane orthogonal to the left and right direction.

The shaft body 131 is formed in a round rod shape extending in the left and right direction. As shown in FIG. 2, the shaft body 131 is fitted into a second support concave portion 82 formed in the pair of side wall portions 77 of the support portion 15 to be rotatable around the central axis. The second support concave portion 82 is disposed behind the stem 12. The stopper 130 is mounted on the support portion 15 to be rotatable around the shaft body 131 behind the stem 12.

As shown in FIG. 6, the connecting base portion 133 is a prismatic body extending in the left and right direction. The connecting base portion 133 extends from one stopper side wall portion 132 to the other stopper side wall portion 132.

The first restricting portion 135 is a substantially rectangular parallelepiped. The first restricting portion 135 extends upward from an upper surface of the connecting base portion 133. The first restricting portion 135 is located at a center of the connecting base portion 133 in the left and right direction. A dimension of the first restricting portion 135 in the left and right direction is smaller than a dimension of the connecting base portion 133 in the left and right direction. A dimension of the first restricting portion 135 in the forward and rearward direction is substantially the same as a dimension of the connecting base portion 133 in the forward and rearward direction. An inclined surface 135*a* inclined downward toward the front side is formed in a front portion of an upper end surface of the first restricting portion 135.

When the stopper 130 is located at the restricted position shown in FIG. 2, the first restricting portion 135 is in contact with or close to the first locked portion 120 from the lower side of the first locked portion 120. An upper end of the first restricting portion 135 engages with the engaging protrusion 122 from the side in front of the engaging protrusion 122 when the stopper 130 is located at the restricted position. When the stopper 130 is located at the restricted position, the first restricting portion 135 and the connecting base portion 133 are sandwiched between a lower surface of the first locked portion 120 and the upper end opening edge 45*e* of the guide tube 45 in the vertical direction.

As shown in FIG. 6, the pair of second restricting portions 136 protrude forward from both ends on a front surface of the connecting base portion 133 in the left and right direction. The second restricting portion 136 includes a base portion 136*a* extending forward from the connecting base portion 133, and a protruding portion 136*b* extending upward from a center of an upper surface of the base portion 136*a* in the forward and rearward direction. A rear surface 136*c* of the protruding portion 136*b* is an inclined surface inclined rearward from the upper side to the lower side. An upper surface 136*d* of the protruding portion 136*b* is, for example, a flat surface orthogonal to the vertical direction.

The distance between a pair of base portions 136*a* in the left and right direction is reduced toward the front side from a position in which the protruding portion 136*b* is provided. The distance between the pair of base portions 136*a* in the left and right direction is substantially the same as an outer diameter of the stem 12 at a position in which the protruding portion 136*b* is provided and smaller than the outer diameter of the stem 12 at a front end of the base portion 136*a*.

A fitting surface 137 is formed by surfaces of the pair of second restricting portions 136 facing each other and directed inward in the left and right direction and by a portion of the front surface of the connecting base portion 133 located between the pair of second restricting portions 136 in the left and right direction. A shape of fitting surface 137 seen in the vertical direction is a C shape which opens forward. When the stopper 130 is located at the restricted position shown in FIG. 2, the fitting surface 137 is fitted onto the outer circumferential surface of the stem 12 from the rear side. As described above, since the distance between the pair of base portions 136*a* in the left and right direction is smaller than the outer diameter of the stem 12 at a front end of the base portion 136*a*, a distance between portions of the fitting surface 137 facing each other in the left and right direction is smaller than the outer diameter of the stem 12 at the front end of the fitting surface 137.

When the fitting surface 137 is fitted onto the outer circumferential surface of the stem 12 and when the fitting surface 137 fitted onto the outer circumferential surface of the stem 12 is removed from the outer circumferential surface of the stem 12, the pair of base portions 136*a* are elastically deformed and widened outward in the left and right direction by the stem 12. Therefore, the distance between the portions of the fitting surface 137 facing each other in the left and right direction is temporarily substantially the same as the outer diameter of the stem 12 at the front end of the fitting surface 137, and it is possible to move the stopper 130 between the restricted position and the non-restricted position.

When the stopper 130 is located at the restricted position shown in FIG. 2, the pair of second restricting portions 136 (protruding portion 136*b*) are in contact with or close to the pair of second locked portions 100A on the lower side of the second locked portion 100A. More specifically, as shown in FIG. 3, when the stopper 130 is located at the restricted position, the upper surface 136*d* of the protruding portion 136*b* comes into contact with or approaches a flat surface 100A1 of the second locked portion 100A from the lower side. When the stopper 130 is located at the restricted position, the second restricting portion 136 (base portion 136*a* and protruding portion 136*b*) is sandwiched between the flat surface 100A1 of the second locked portion 100A and the upper end opening edge 45*e* of the guide tube 45 in the vertical direction.

Figure 5:
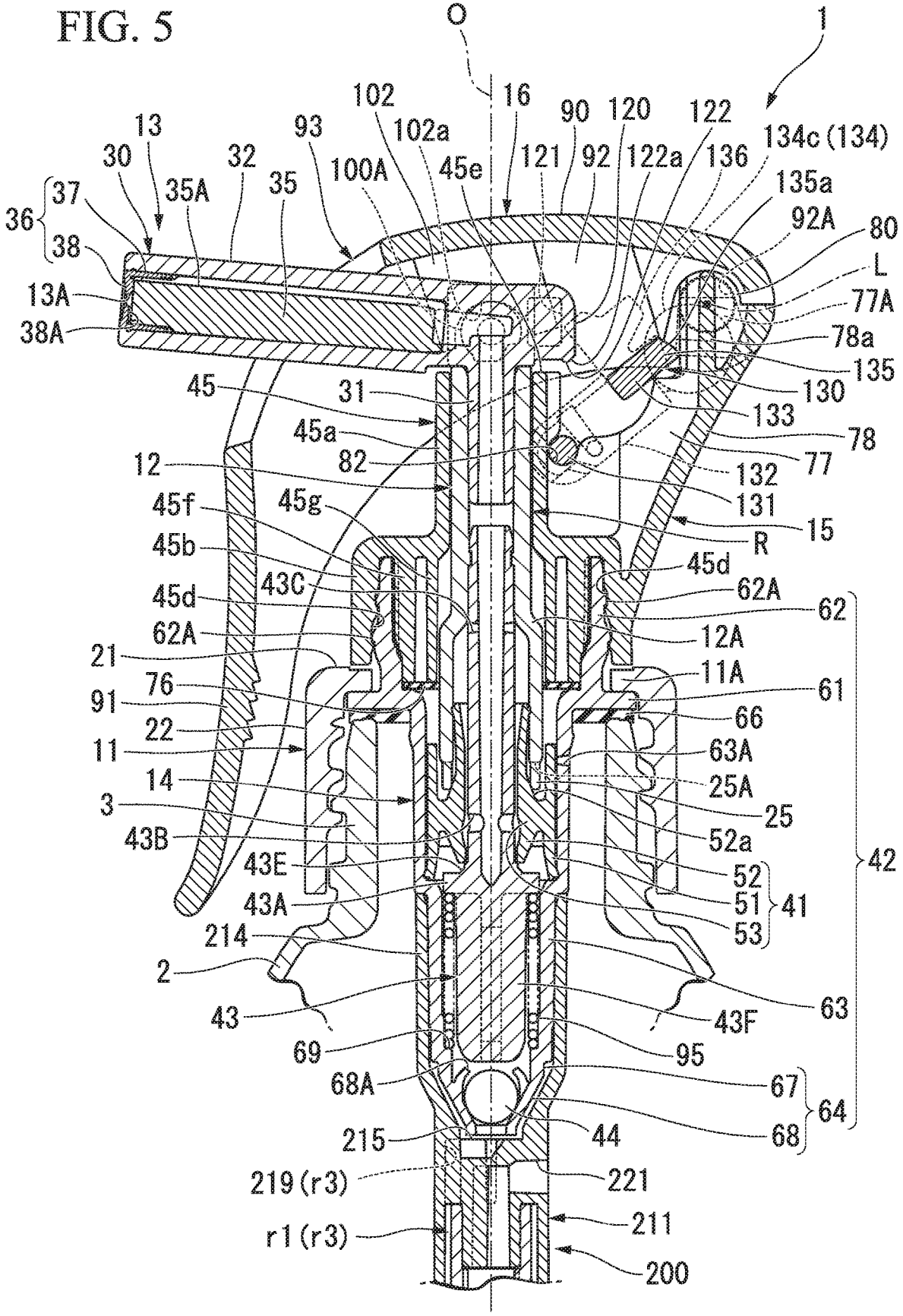
FIG. 5 is a view showing the discharge device and is an axial cross-sectional view showing a state where a discharge head is pressed down by rotating a press-down member downward from a state shown in FIG. 2.

When the stopper 130 is located at the non-restricted position shown in FIG. 5, the first restricting portion 135 is disposed to be apart from the first locked portion 120. When the stopper 130 is located at the non-restricted position, the second restricting portion 136 is disposed to be apart from the second locked portion 100A. An upper end of the first restricting portion 135 and upper ends of the pair of second restricting portions 136 (upper end of the protruding portion 136*b*) are, for example, substantially at the same position in the vertical direction.

As shown in FIG. 6, the knob portion 134 includes a first arm portion 134*a* extending outward from the stopper side wall portion 132 in the left and right direction, a second arm portion 134*b* extending upward from an outer end of the first arm portion 134*a* in the left and right direction, and a finger hooking portion 134*c* provided at an upper end of the second arm portion 134*b*.

The first arm portion 134*a* and the second arm portion 134*b* are provided with a prismatic shape. As shown in FIG. 4, the outer end of the first arm portion 134*a* in the left and right direction is located on the outside of the press-down member 16 (the side plate portion 92) in the left and right direction. Therefore, the second arm portion 134*b* and the finger hooking portion 134*c* are located on the outside of the press-down member 16 (the side plate portion 92) in the left and right direction. As shown in FIG. 6, the shape of the finger hooking portion 134*c* in a front view seen in the left and right direction is a substantially circular shape. An outer diameter of the finger hooking portion 134*c* is larger than a dimension of the second arm portion 134*b* in the forward and rearward direction.

Figure 7:
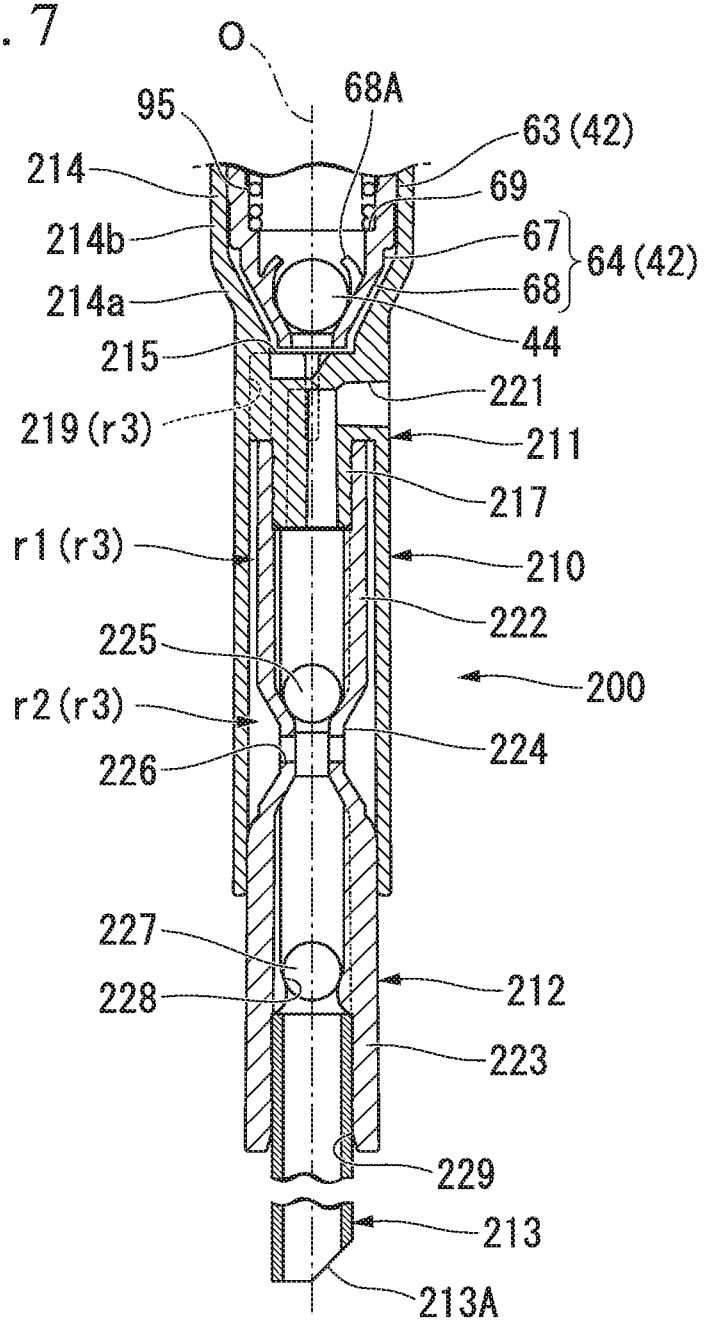
FIG. 7 is an axial cross-sectional view showing a lower half of the discharge device shown in FIG. 1.

As shown in FIG. 7, the invertible adapter 200 includes a main body tube portion 210 provided with a cylindrical shape. The main body tube portion 210 is disposed coaxially with the central axis O. The main body tube portion 210 includes a outer tube member 211 provided with a cylindrical shape and fitted onto the cylinder 42, and an inner tube member 212 of which an upper portion is disposed within the outer tube member 211 and of which a lower portion protrudes downward from the outer tube member 211. An upper end of a pipe 213 provided with a cylindrical shape and through which the contents in the container body 2 flow is fitted in a lower end of the inner tube member 212. The outer tube member 211, the inner tube member 212, and the pipe 213 are disposed coaxially with the central axis O.

The outer tube member 211 includes an outer tube portion 214 provided with a cylindrical shape and of which the upper tube portion 63 of the cylinder 42 is fitted in an upper end, a partition wall portion 215 disposed in a middle portion of the outer tube portion 214 in the vertical direction and partitioning the inside of the outer tube portion 214 vertically, and a lower tube portion 217 provided with a cylindrical shape, extending downward from the partition wall portion 215, and to which an upper end of the inner tube member 212 connected.

An inner diameter and an outer diameter of a portion of the outer tube portion 214 located above the partition wall portion 215 are larger than an inner diameter and an outer diameter of a portion of the outer tube portion 214 located below the partition wall portion 215. The portion of the outer tube portion 214 located above the partition wall portion 215 is formed such that a diameter thereof is enlarged from the lower side to the upper side. In the illustrated example, the portion of the outer tube portion 214 located above the partition wall portion 215 includes an enlarged diameter portion 214*a* having a diameter gradually expanding upward from the partition wall portion 215, and a tube portion 214*b* having the same diameter as that of an upper end of the enlarged diameter portion 214*a* and located above the enlarged diameter portion 214*a*. An inner diameter of the tube portion 214*b* is equal to an outer diameter of the upper tube portion 63 of the cylinder 42. A liquid path hole 219 penetrating in the vertical direction is formed in the partition wall portion 215.

A portion of an outer circumferential surface of an upper end of the lower tube portion 217 is connected to an inner circumferential surface of the outer tube portion 214 and the other portion of the outer circumferential surface of an upper end of the lower tube portion 217 forms a gap in the radial direction together between the inner circumferential surface of the outer tube portion 214 and the other portion. Additionally, an inverted-state introduction hole 221 radially integrally passing through a part of the upper end of the lower tube portion 217 connected to the inner circumferential surface of the outer tube portion 214 and the outer tube portion 214, is formed in the outer tube member 211. The inverted-state introduction hole 221 allows introduction of the liquid contents in the container body 2 when the discharge device 1 is inverted.

The inner tube member 212 includes an upper side tube portion 222 provided with a cylindrical shape and of which an upper end is connected to the lower tube portion 217, a lower side tube portion 223 provided with a cylindrical shape, disposed below the upper side tube portion 222, and of which a lower portion protrudes downward from the outer tube member 211, and a coupling tube portion 224 provided with a cylindrical shape and which couples the upper side tube portion 222 with the lower side tube portion 223.

An upper end of the upper side tube portion 222 is fitted onto the lower tube portion 217. Additionally, a first flow path r1 through which the liquid contents flow is formed between an outer circumferential surface of the upper side tube portion 222 and the inner circumferential surface of the outer tube portion 214. The first flow path r1 communicates with the liquid path hole 219. A lower end of the upper side tube portion 222 has a tapered shape in which an inner diameter and an outer diameter are gradually reduced as going downward, and a spherical switching valve 225 is disposed inside the upper side tube portion 222.

A second flow path r2 through which the liquid contents flow is formed between an outer circumferential surface of the coupling tube portion 224 and the inner circumferential surface of the outer tube portion 214. The second flow path r2 communicates with the first flow path r1. A communicating hole 226 communicating the inside thereof with the second flow path r2 is formed in the coupling tube portion 224. A plurality of communicating holes 226 are formed in the coupling tube portion 224 at intervals in the circumferential direction. Here, the communicating hole 226, the second flow path r2, the first flow path r1, and the liquid path hole 219 form a communication path r3 communicating an upright-state introduction hole 229 located at the lower end of the inner tube member 212 and an inverted-state introduction hole 221 with a lower end opening of the cylinder 42. The upright-state introduction hole 229 is disposed below the inverted-state introduction hole 221.

The lower side tube portion 223 is fitted into a lower end of the outer side tube member 211. Further, an upper end of the lower side tube portion 223 has a tapered shape in which an inner diameter and an outer diameter are gradually reduced as going upward, and a spherical lower valve body 227 is disposed inside the lower side tube portion 223. In an inner circumferential surface of the lower side tube portion 223, a plurality of second vertical rib portions 228 protruding inward in the radial direction and extending in the vertical direction are formed at intervals in the circumferential direction. A lower end of the second vertical rib portion 228 protrudes inward in the radial direction and restricts the lower valve body 227 from moving downward beyond the lower end of the second vertical rib portion 228.

The upper end of the pipe 213 is fitted into a lower end of the lower side tube portion 223, and a lower end opening of the pipe 213 forms a lower end opening 213A opening toward a bottom portion inside the container body 2. The lower end opening 213A and the upright-state introduction hole 229 allow the liquid in the container main body 2 contents to be introduced when the discharge device 1 is upright. The contents are introduced into the upright-state introduction hole 229 through the pipe 213.

Next, a method of using the discharge 1 constituted as described above will be described. First, the stopper 130 is tilted rearward from the above-described restricted position shown in FIG. 2 and moved to the non-restricted position shown in FIG. 5. More specifically, the stopper 130 is rotated rearward around the shaft body 131 until the first restricting portion 135 is located behind the first locked portion 120 beyond the engaging protrusion 122 and the pair of second restricting portions 136 are also located behind the second locked portion 100A. Accordingly, the restriction of the downward movement of the discharge head 13 due to the stopper 130 is released, and downward pivoting of the press-down member 16 is allowed.

Thereafter, as shown in FIG. 5, the press-down member 16 is rotated downward around the rotating axis L. At this time, for example, the press-down member 16 is rotated downward against the pushing force of the coil spring 95 while the fingertip is put on the finger hooking portion of the front plate portion 91 of the press-down member 16. When the press-down member 16 is rotated downward, the discharge head 13 is moved downward, the stem 12 and the piston 41 are pushed against the cylinder 42 in a state where the inside of the tapered tube portion 68 of the cylinder 42 is closed by the valve body 44, and the inside of the cylinder 42 becomes a positive pressure. Then, the liquid contents in the cylinder 42 rise in the stem 12, and the liquid contents are introduced into the nozzle tube portion 32 and discharged from the discharge hole 13A of the discharge head 13.

Specifically, when the inside of the cylinder 42 becomes the positive pressure, the elastic portion 25 contracts and deforms such that a vertical length of the elastic portion 25 becomes short while a free end of the elastic portion 25 is sliding to warp radially outward along the tapered portion 52*a* on the outer circumferential surface of the closing portion 52. Further, the discharge head 13 and the piston guide 43 begin to move downward with respect to the piston 41. When the discharge head 13 and the piston guide 43 move downward with respect to the piston 41, the lower end of the closing portion 52 of the piston 41 is separated from the contact portion 43E of the piston guide 43. Therefore, a gap is formed between the lower end of the closing portion 52 and an outer circumferential surface of the piston guide 43. Thus, the communication hole 43B opens to the inside of the upper tube portion 63 of the cylinder 42 through the gap. The internal pressure of the upper tube portion 63 further increases until the communication hole 43B opens to the inside of the upper tube portion 63 of the cylinder 42.

Accordingly, the contents in the upper tube portion 63 flows into the piston guide 43 through a gap between an inner circumferential surface of the closing portion 52 and the outer circumferential surface of the piston guide 43 and the communication hole 43B. Furthermore, the contents in the upper tube portion 63 flows into the piston guide 43 through the gap between the inner circumferential surface of the closing portion 52 and the outer circumferential surface of the piston guide 43, a gap between the inner circumferential surfaces of the lower portion of the stem 12 and the enlarged diameter portion 12A and the outer circumferential surface of the piston guide 43, and the through-hole 43C. Additionally, the contents introduced into the piston guide 43 flow in the upper portion of the stem 12, reach the nozzle tube portion 32, and are discharged from the discharge hole 13A of the nozzle tube portion 32. As a result, the contents stored in the container body 2 can be discharged to the outside through the discharge holes 13A.

Thereafter, when gripping of the press-down member 16 is released, the stem 12 and the piston 41 move and restore with respect to the cylinder 42 on the basis of the pushing force from the coil spring 95. At this time, the inside of the cylinder 42 becomes a negative pressure. This negative pressure acts on the valve body 44 to open the inside of the tapered tube portion 68 and acts through the communication path r3 on each of the switching valve 225 and the lower valve body 227 shown in FIG. 7. Then, when the dispenser 1 is upright, a state in which the switching valve 225 cuts off communication between the inverted-state induction hole 221 and the communication path r3 is maintained, and the lower valve body 227 is separated from the lower end of the second vertical rib portion 228. As a result, the liquid contents in the container body 2 reach the lower end opening of the cylinder 42 through the upright-state introduction hole 229, the inside of the main body tube portion 210, and the communication path r3 and flows into the cylinder 42.

On the other hand, when the discharge device 1 is inverted, the lower end opening 213A of the pipe 213 opening to the bottom portion inside the container body 2 protrudes from a liquid surface of the liquid contents in the container body 2. In addition, in a state where the inverted-state introduction hole 221 is located in the liquid contents inside the container body 2, the switching valve 225 is separated from the inside of the upper side tube portion 222 on the basis of its own weight, and the inverted-state introduction hole 221 and the communication path r3 communicate with each other through the inside of the main body tube portion 210. Therefore, a negative pressure is generated in the cylinder 42, and thus the liquid contents in the container body 2 reach the lower end opening of the cylinder 42 through the inverted-state introduction hole 221, the inside of the main body tube portion 210, and the communication path r3 and flow into the cylinder 42.

When the discharge head 13, the stem 12, and the piston 41 are pressed integrally with respect to the cylinder 42 regardless of whether the discharge device 1 is upright or inverted, a lower space located below the piston 41 in the cylinder 42 is pressurized, and the contents in the lower space rise in the stem 12 and are discharged from the discharge hole 13A. In this process, the second packing 76 opens a lower end opening of the external air introduction path R, and the external air introduction path R communicates with an upper space in the cylinder 42, and the outside air is introduced into the upper space inside the cylinder 42.

When the pressing-down of the discharge head 13, the stem 12 and the piston 41 is released and the discharge head 13, the stem 12 and the piston 41 are displaced upward and restored, the lower space in the cylinder 42 becomes a negative pressure, and the contents in the container body 2 are introduced into the lower space inside the cylinder 42. In this process, the air in the upper space is compressed. The air in the upper space is introduced into the container main body 2 by communicating the upper space in the cylinder 42 with the inside of the container body 2 through the air hole 63A.

Thereafter, when the stem 12 and the piston 41 return to their original positions, the piston 41 closes the air hole 63A, and the communication between the inside and the outside of the container body 2 through the external air introduction path R is interrupted. The second packing 76 configured to cut off communication between the external air introduction path R and the upper space in the cylinder 42 is also disposed. Therefore, it is possible to prevent the contents from leaking to the outside through the external air introduction path R even when the contents in the container body 2 reach the upper space inside the cylinder 42 due to the inverted state of the discharge device 1 or the like.

Next, in order to prevent the contents from being discharged from the discharge device 1 to the outside when the discharge device 1 is not in use, the stopper 130 is moved and positioned to the restricted position as shown in FIG. 2. Specifically, the discharge head 13 is pushed upward by the coil spring 95, the press-down member 16 comes into contact with the support portion 15, the upward rotation of the press-down member 16 is restricted, and the pump 14 is in a stopped state. In this state, when the stopper 130 moves to the restricted position, the first restricting portion 135 comes into contact with or approaches the lower surface of the first locked portion 120, and the second restricting portion 136 comes into contact with or approaches the lower surface of the second locked portion 100A.

In the embodiment, since the inclined surface 122*a* is formed on the engaging protrusion 122 of the first locked portion 120 and the inclined surface 135*a* is formed at the front end of the upper surface of the first restricting portion 135 of the stopper 130, the first restricting portion 135 easily moves over the engaging protrusion 122 to the restricted position. Further, in the embodiment, since the second locked portion 100A has the inclined surface 100A2, when the second restricting portion 136 moves to the restricted position, it is difficult for the protruding portion 136*b* to come into contact with the second locked portion 100A, and the second restricting portion 136 is easily moved to the restricted position. In this way, in the embodiment, the stopper 130 can be easily moved to the restricted position.

When the stopper 130 is located at the restricted position, the first restricting portion 135 and the connecting base portion 133 are sandwiched between the lower surface of the first locked portion 120 and the upper end opening edge 45*e* of the guide tube 45 in the vertical direction. Further, the second restricting portion 136 (the base portion 136*a* and the protruding portion 136*b*) is sandwiched between the flat surface 100A1 of the second locked portion 100A and the upper end opening edge 45*e* of the guide tube 45 in the vertical direction. Thus, a pressing-down force applied to the discharge head 13 acts on the guide tube 45 without changing a direction of the force. Since the guide tube 45 is a tube body surrounding the stem 12 of the discharge head 13 from the outside and having high rigidity in the vertical direction, it is possible to sufficiently support the force received by the discharge head 13.

Further, the engaging protrusion 122 configured to prevent movement of the stopper 130 from the restricted position to the non-restricted position by engaging with the stopper 130 is formed on the first locked portion 120. According to such a constitution, since the engaging protrusion 122 formed on the first locked portion 120 suppresses the movement of the stopper 130 from the restricted position to the non-restricted position, it is difficult for the stopper 130 to move from the restricted position, and the downward movement of the discharge head 13 can be restricted. Accordingly, since it is possible to suppress the movement of the stopper 130 from the restricted position to the non-restricted position with a slight force, the contents are not erroneously discharged.

In addition, the fitting surface 137 is formed on the stopper 130, and the distance between the portions of the fitting surface 137 facing each other in the left and right direction is smaller than the outer diameter of the stem 12 at the front end of the fitting surface 137. Therefore, when the stopper 130 is located at the restricted position and the fitting surface 137 is fitted onto the outer circumferential surface of the stem 12 from the rear side, a front end of the fitting surface 137 engages with the outer circumferential surface of the stem 12 from the front side. Therefore, the movement of the stopper 130 in the rearward direction is suppressed, and it is possible to further suppress the stopper 130 moving from the restricted position to the non-restricted position with a slight force.

As described above, according to the discharge device 1 of the embodiment, when the stopper 130 is moved to the restricted position, the stopper 130 comes into contact with or approaches the first locked portion 120 and the second locked portion 100A of the discharge head 13. Therefore, since the stopper 130 comes into contact with the first locked portion 120 and the second locked portion 100A and directly supports the discharge head 13 even when a force is applied to the discharge head 13 alone, the contents are not discharged. On the other hand, as shown in FIG. 5, when the stopper 130 is moved to the non-restricted position, the stopper 130 is apart from the first locked portion 120 and the second locked portion 100A which protrude from the discharge head 13. Therefore, the downward movement of the discharge head 13 is allowed, and usual use of the discharge device 1 becomes possible.

As described above, the embodiment adopts a configuration in which "a discharge device 1 including a pump 14 disposed in a mouth portion 3 of a container body 2, in which contents are stored, to be movable downward in a state where an upward force is applied to the pump, the pump including a discharge head 13 provided with a discharge hole 13A opening forward; a mounting cap 11 mounting the pump 14 on the mouth portion 3 of the container body 2; a support portion 15 standing up on a rear portion of the mounting cap 11; and a press-down member 16 disposed at the support portion 15 to be rotatable around a rotating axis L and configured to press the discharge head 13 down, wherein by rotating the press-down member 16 downward around the rotating axis L, the discharge head 13 is moved downward and the contents are discharged from the discharge hole 13A, wherein the discharge device 1 includes a stopper 130 which is movable between a restricted position where downward movement of the discharge head 13 is restricted and a non-restricted position where the downward movement of the discharge head 13 is allowed, wherein the discharge head 13 includes a stem 12 disposed to be movable downward in a state where an upward force is applied to the stem, a mounting tube portion 31 mounted on an upper end of the stem 12, a nozzle tube portion 32 protruding forward from the mounting tube portion 31 and provided with the discharge hole 13A formed in a front end of the nozzle tube portion 32, a first locked portion 120 protruding rearward from the mounting tube portion 31, and a pair of second locked portions 100A protruding from the mounting tube portion 31 toward both sides in left and right direction orthogonal to a forward and rear direction and to a vertical direction, wherein the press-down member 16 has a pair of engaging portions 102 configured to engage with the pair of the second locked portions 100A from an upper side and to press the discharge head 13 down via the second locked portion 100A, wherein the stopper 130 has a first restricting portion 135 and a second restricting portion 136, wherein the first restricting portion 135 is disposed to be in contact with or close to the first locked portion 120 on a lower side of the first locked portion 120 when the stopper 130 is located at the restricted position and is disposed to be apart from the first locked portion 120 when the stopper 130 is located at the non-restricted position, and the second restricting portion 136 is disposed to be in contact with or close to the pair of the second locked portions 100A on a lower side of the second locked portions 100A when the stopper 130 is located at the restricted position and is also disposed to be apart from the second locked portions 100A when the stopper 130 is located at the non-restricted position." Therefore, it is possible to more reliably prevent the discharge of the contents when the discharge device 1 is not in use.

Further, according to the embodiment, since the discharge head 13 can be supported from the lower side at three positions by the first restricting portion 135 and the pair of second restricting portions 136, the movement of the discharge head 13 can be more stably restricted by the stopper 130. Accordingly, it is possible to more reliably prevent the discharge of the contents when the discharge device 1 is not in use.

Further, the first locked portion 120 protruding rearward from the mounting tube portion 31 mounted on the upper end of the stem 12 is supported by the first restricting portion 135, and the second locked portions 100A protruding from the mounting tube portion 31 toward both sides in the left and right direction are supported by the second restricting portions 136. Therefore, the stem 12 is surrounded in three directions, and thus the discharge head 13 can be supported by the stopper 130. Accordingly, the discharge head 13 can be stably supported by the stopper 130, and the downward movement of the discharge head 13 can be more stably restricted.

Further, according to the embodiment, a position of the upper end of the first restricting portion 135 and positions of the upper ends of the pair of second restricting portions 136 are substantially at the same position in the vertical direction. Therefore, the upper end of the first restricting portion 135 and the upper ends of the pair of second restricting portions 136 are disposed on the same plane orthogonal to the vertical direction, and the discharge head 13 can be more stably supported by the three upper ends. Therefore, it is possible to restrict the downward movement of the discharge head 13 more stably.

Further, for example, when an external force directed downward is applied to the nozzle tube portion, a counter-clockwise rotation moment is applied to the discharge head around the central axis of the second locked portion when seen in the direction of FIG. 2. Therefore, a force may be also applied to the head body in a rotating direction, and thus the head body may tilt with respect to the stem. Accordingly, a gap is generated between the mounting tube portion of the head body and the stem, and sealing performance between the mounting tube portion and the stem may be deteriorated. As a result, the contents inside the container body 2 may leak out from the gap between the mounting tube portion and the stem to the outside.

Further, for example, a case in which the stopper has only the first restricting portion which restricts the movement of the first locked portion provided behind the stem will be considered. In this case, when an external force directed downward is applied to the nozzle tube portion, an upward force is applied to the first locked portion located behind the stem due to a rotation moment applied to the discharge head. Therefore, the first locked portion may rise from the first restricting portion of the stopper, and the stopper may move over the engaging protrusion and may be displaced toward the non-restricted position.

In response to these problems, according to the embodiment, the stopper 130 has the second restricting portion 136 which restricts the movement of the second locked portion 100A in addition to the first restricting portion 135. Since the second locked portion 100A protrudes from the mounting tube portion 31 to both sides in the left and right direction, the second locked portion 100A is located in front of the first restricting portion 135 and is located at substantially the same position in the forward and rearward direction as the upper end of the stem 12 to which the mounting tube portion 31 is mounted. Therefore, when an external force is applied to the nozzle tube portion 32, the external force applied to the nozzle tube portion 32 can be received by the second restricting portion 136 at substantially the same position as that of the upper end of the stem 12 in the forward and rearward direction. Therefore, it is possible to reduce the rotation moment transmitted to the head body 30 when the external force is applied to the nozzle tube portion 32 and to suppress the tilt of the head body 30 with respect to the stem 12. Accordingly, it is possible to suppress the deterioration of the sealing performance between the stem 12 and the mounting tube portion 31 and to minimize the leakage of the contents to the outside.

Further, since the second locked portion 100A is located at substantially the same position as the stem 12 in the forward and rearward direction, when a downward external force is applied to the nozzle tube portion 32, a force is applied to the second locked portion 100A in a direction of pressing the second locked portion 100A against the second restricting portion 136. Therefore, the second restricting portion 136 is pressed against the upper end opening edge 45*e* of the guide tube 45 from the upper side.

Accordingly, even when an external force is applied to the nozzle tube portion 32 and the first locked portion 120 rises with respect to the first restricting portion 135, the second restricting portion 136 is pressed against the guide tube 45 by the second locked portion 100A. As a result, the stopper 130 can be prevented from being shifted toward the non-restricted position. In addition, the downward movement of the discharge head 13 can be suppressed.

Further, since the second locked portion 100A is located at substantially the same position as the stem 12 in the forward and rearward direction, it is possible to support the discharge head 13 such that a center of the stem 12 in the forward and rearward direction is sandwiched from both sides in the left and right direction by supporting the second locked portion 100A with the second restricting portion 136. Therefore, it is possible to more stably restrict the downward movement of the discharge head 13.

Further, the second locked portion 100A is a portion which is engaged with the engaging portion 102 of the press-down member 16 and is a portion which directly receives a force from the press-down member 16. Therefore, the second locked portion 100A is supported by the second restricting portion 136, and thus the force applied to the discharge head 13 from the press-down member 16 can be directly received by the stopper 130. Accordingly, the discharge head 13 can be more stably supported by the stopper 130, and the downward movement of the discharge head 13 can be more stably restricted.

When an external force is applied to the discharge head 13, the external force is particularly easily applied to the nozzle tube portion 32 of the discharge heads 13. Therefore, it is possible to effectively achieve the operational effect of the above-described embodiment.

Further, according to the embodiment, the second locked portion 100A has the flat surface 100A1 facing the upper end (the upper end of the protruding portion 136*b*) of the second restricting portion 136 when the stopper 130 is located at the restricted position. Therefore, the second restricting portion 136 can stably restrict the movement of the second locked portion 100A. Accordingly, it is possible to further minimize the leakage of the contents to the outside.

Although the preferred embodiment of the present invention has been described with reference to the drawings, the present invention is not limited to the above-described embodiment. The shapes, combinations or the like of the constituent members shown in the above-described embodiment are merely examples, and various modifications can be made based on design requirements or the like without departing from the scope of the present invention.

For example, in the above-described embodiment, the case in which the stopper 130 comes into contact with the first locked portion 120 and the second locked portion 100A when the stopper 130 is located at the restricted position has been described, but the present invention is not limited thereto. For example, the stopper 130 only needs to be in proximity to the first locked portion 120 and the second locked portion 100A without being in contact with them. Even in this case, it is possible to restrict the movement of the discharge head 13 toward the lower side.

Further, for example, in the above-described embodiment, the case in which the stopper 130 is provided to be rotatable around the shaft body 131 has been described, but the present invention is not limited thereto. For example, the stopper 130 may be provided to be movable between the restricted position and the non-restricted position by movement in the vertical direction, the left and right direction or the forward and rearward direction instead of the rotation.

Also, the discharge device 1 does not have to include the invertible adapter 200. In this case, the pipe 213 is mounted on the lower end of the cylinder 42.

INDUSTRIAL APPLICABILITY

According to the discharge device of the present invention, it is possible to more reliably prevent the contents from being discharged when the discharge device is not in use.

REFERENCE SIGNS LIST

1 Discharge device
2 Container body
3 Mouth portion
11 Mounting cap
12 Stem
13 Discharge head
13A Discharge hole
14 Pump
15 Support portion
16 Press-down member
31 Mounting tube portion
32 Nozzle tube portion
100A Second locked portion
100A1 Flat surface
102 Engaging portion
120 First locked portion
130 Stopper
135 First restricting portion
136 Second restricting portion
L Rotating axis

The invention claimed is:

1. A discharge device comprising:

a pump disposed in a mouth portion of a container body, in which contents are stored, to be movable downward in a state where an upward force is applied to the pump, the pump including a discharge head provided with a discharge hole opening forward;

a mounting cap mounting the pump on the mouth portion of the container body;

a support portion standing up on a rear portion of the mounting cap; and a press-down member disposed at the support portion to be rotatable around a rotating axis and configured to press the discharge head down, wherein by rotating the press-down member downward around the rotating axis, the discharge head is moved downward and the contents are discharged from the discharge hole, wherein the discharge device comprises:

a stopper which is movable between a restricted position where downward movement of the discharge head is restricted and a non-restricted position where the downward movement of the discharge head is allowed;

wherein the discharge head includes:

a stem disposed to be movable downward in a state where an upward force is applied to the stem;

a mounting tube portion mounted on an upper end of the stem;

a nozzle tube portion protruding forward from the mounting tube portion and provided with the discharge hole formed in a front end of the nozzle tube portion;

a first locked portion protruding rearward from the mounting tube portion, and a pair of second locked portions protruding from the mounting tube portion toward both sides in a left and right direction orthogonal to a forward and rear direction and to a vertical direction, wherein the press-down member has a pair of engaging portions configured to engage with the pair of the second locked portions from an upper side and to press the discharge head down via the second locked portion, wherein the stopper has a first restricting portion and a second restricting portion, wherein the first restricting portion is disposed to be into contact with or to be separated from and contactable with the first locked portion on a lower side of the first locked portion when the stopper is located at the restricted position and is disposed to be apart from the first locked portion when the stopper is located at the non-restricted position, and the second restricting portion is disposed to be into contact with or to be separated from and contactable with the pair of the second locked portions on a lower side of the second locked portions when the stopper is located at the restricted position and is disposed to be apart from the second locked portions when the stopper is located at the non-restricted position.

2. A discharge device comprising:

a pump disposed in a mouth portion of a container body, in which contents are stored, to be movable downward in a state where an upward force is applied to the pump, the pump including a discharge head provided with a discharge hole opening forward;

a mounting cap mounting the pump on the mouth portion of the container body;

a support portion standing up on a rear portion of the mounting cap; and a press-down member disposed at the support portion to be rotatable around a rotating axis and configured to press the discharge head down, wherein by rotating the press-down member downward around the rotating axis, the discharge head is moved downward and the contents are discharged from the discharge hole, wherein the discharge device comprises:

a stopper which is movable between a restricted position where downward movement of the discharge head is restricted and a non-restricted position where the downward movement of the discharge head is allowed;

wherein the discharge head includes:

a stem disposed to be movable downward in a state where an upward force is applied to the stem;

a mounting tube portion mounted on an upper end of the stem;

a nozzle tube portion protruding forward from the mounting tube portion and provided with the discharge hole formed in a front end of the nozzle tube portion;

a first locked portion protruding rearward from the mounting tube portion, and a pair of second locked portions protruding from the mounting tube portion toward both sides in a left and right direction orthogonal to a forward and rear direction and to a vertical direction, wherein the press-down member has a pair of engaging portions configured to engage with the pair of the second locked portions from an upper side and to press the discharge head down via the second locked portion, wherein the stopper has a first restricting portion and a second restricting portion, wherein the first restricting portion is disposed to be into contact with or to be separated from and contactable with the first locked portion on a lower side of the first locked portion when the stopper is located at the restricted position and is disposed to be apart from the first locked portion when the stopper is located at the non-restricted position, and the second restricting portion is disposed to be into contact with or to be separated from and contactable with the pair of the second locked portions on a lower side of the second locked portions when the stopper is located at the restricted position and is disposed to be apart from the second locked portions when the stopper is located at the non-restricted position, and wherein each one of the second locked portions has a flat surface configured to face an upper end of the second restricting portion when the stopper is located at the restricted position.

* * * * *